US005097934A

United States Patent [19]

Quinlan, Jr.

[11] Patent Number: 5,097,934

[45] Date of Patent: Mar. 24, 1992

[54] COIN SENSING APPARATUS

[75] Inventor: Thomas J. Quinlan, Jr., Beach Haven Terrace, N.J.

[73] Assignee: Automatic Toll Systems, Inc., Teterboro, N.J.

[21] Appl. No.: 491,245

[22] Filed: Mar. 9, 1990

[51] Int. Cl.[5] ..... G07D 5/02; G07D 5/08

[52] U.S. Cl. ..... 194/200; 194/318; 194/334

[58] Field of Search ..... 194/318, 319, 334, 200; 453/3, 4

[56] References Cited

U.S. PATENT DOCUMENTS

| | | | |
|---|---|---|---|
| 2,950,799 | 8/1960 | Timms | 194/317 X |
| 3,481,443 | 12/1969 | Meloni . | |
| 3,680,566 | 8/1972 | Tanaka et al. | 453/4 |
| 3,869,663 | 3/1975 | Tschierse | 194/318 X |
| 3,901,368 | 8/1975 | Klinger . | |
| 3,966,034 | 6/1976 | Heiman et al. . | |
| 4,059,122 | 11/1977 | Kinoshita | 453/3 |
| 4,086,527 | 4/1978 | Cadot | 324/233 |
| 4,108,296 | 8/1978 | Hayashi et al. | 194/318 |
| 4,128,158 | 12/1978 | Dautremont et al. . | |
| 4,184,366 | 1/1980 | Butler . | |
| 4,234,071 | 11/1980 | LeHong . | |
| 4,254,857 | 3/1981 | Levasseur et al. . | |
| 4,275,806 | 6/1981 | Tanaka et al. . | |
| 4,334,604 | 6/1982 | Davis . | |
| 4,349,095 | 9/1982 | Lewis . | |
| 4,361,218 | 11/1982 | Van Dort . | |
| 4,398,626 | 8/1983 | Barnes et al. . | |
| 4,431,014 | 2/1984 | Yokomori . | |
| 4,460,003 | 7/1984 | Barnes et al. . | |
| 4,460,080 | 7/1984 | Howard . | |
| 4,462,513 | 7/1984 | Dean et al. . | |
| 4,471,864 | 9/1984 | Marshall . | |
| 4,474,281 | 10/1984 | Roberts et al. | 194/334 X |
| 4,493,411 | 1/1985 | Heiman . | |
| 4,509,633 | 4/1985 | Chow . | |
| 4,538,719 | 9/1985 | Gray et al. . | |
| 4,572,349 | 2/1986 | Furuza et al. . | |
| 4,625,852 | 12/1986 | Hoormann . | |
| 4,646,904 | 3/1987 | Hoormann | 194/334 |
| 4,666,027 | 5/1987 | Ostroski et al. . | |
| 4,705,154 | 11/1987 | Masho et al. . | |
| 4,749,074 | 6/1988 | Ueki et al. . | |
| 4,845,994 | 7/1989 | Quinlan et al. . | |
| 4,846,332 | 7/1989 | Quinlan et al. . | |

FOREIGN PATENT DOCUMENTS

WO83/03154 9/1983 Fed. Rep. of Germany .

OTHER PUBLICATIONS

Hewlett Packard HCTL-2000; Jan. 1986.
Analog Devices AD1170; Sep. 1986.
Analog Devices AD521, undated.
Analog Devices AD 536A; undated.

*Primary Examiner*—F. J. Bartuska
*Attorney, Agent, or Firm*—Theodore F. Shiells

[57] ABSTRACT

Counterfeit coin sensing apparatus including a transport system for continuously directing a plurality of successive coins along a feed path. A first coin sensor is disposed along the feed path for producing a denomination output signal corresponding to the diameter of each coin, and a second coin sensor is arranged along the path to produce a phase and amplitude displacement output signal corresponding to the metal content of the coin. The output signals from the two sensors are received by an acquisition system which converts the signals into corresponding standardized signals and then directs the standardized signals to an analysis system which compares the denomination and phase and amplitude displacement signals with stored signals representative of valid coins. When the sum of valid coins as represented by the two signals equal the correct fare, the analysis system produces a validation signal which initiates the transfer of each group of received coins into a first coin collector and then into a second coin collector. The coins in the first and second coin collectors may be cross-checked visually before being sent to storage.

14 Claims, 6 Drawing Sheets

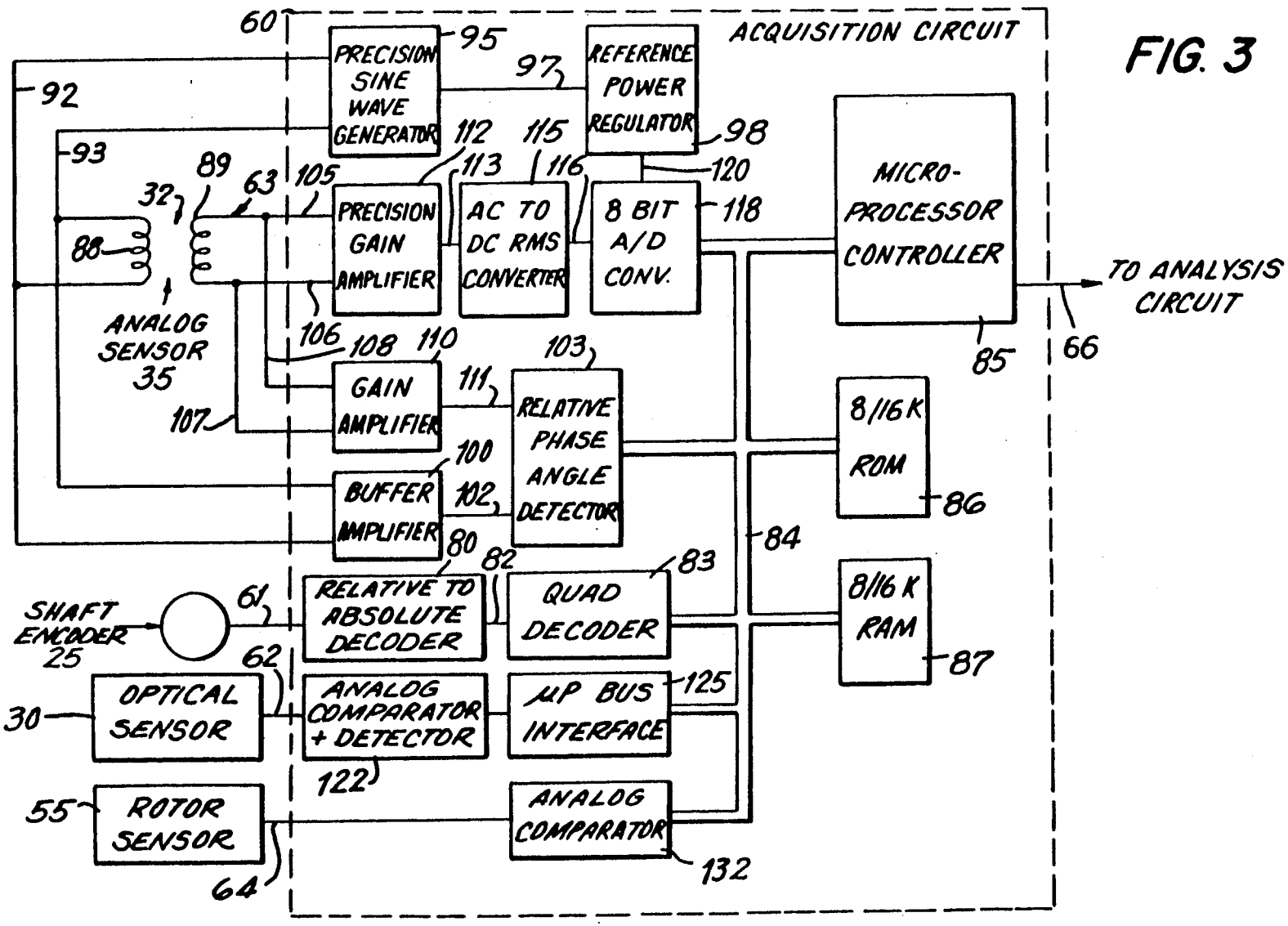
FIG. 3
TO ANALYSIS CIRCUIT
66
ACQUISITION CIRCUIT
MICRO-PROCESSOR CONTROLLER
85
8/16 K ROM
86
8/16 K RAM
87
84
REFERENCE POWER REGULATOR
98
120
8 BIT A/D CONV.
118
AC TO DC RMS CONVERTER
116
115
97
PRECISION SINE WAVE GENERATOR
95
112
113
PRECISION GAIN AMPLIFIER
105
106
108
GAIN AMPLIFIER
110
111
RELATIVE PHASE ANGLE DETECTOR
103
BUFFER AMPLIFIER
100
102
80
QUAD DECODER
83
RELATIVE TO ABSOLUTE DECODER
82
μP BUS INTERFACE
125
ANALOG COMPARATOR + DETECTOR
122
ANALOG COMPARATOR
132
60
63
89
32
88
93
92
ANALOG SENSOR 35
107
61
SHAFT ENCODER 25
62
OPTICAL SENSOR
30
ROTOR SENSOR
55
64

COIN SENSING APPARATUS

BACKGROUND OF THE INVENTION

This invention relates to coin sensing apparatus and more particularly to apparatus for sensing groups of valid coins corresponding to a correct fare.

The present invention, while of general application, is particularly well suited for use at automatic toll collection stations for highways, bridges, tunnels, parking lots, etc. For these and other coin sensing applications it is particularly important to be able to distinguish between genuine coins and counterfeits such as metallic slugs or foreign coins and to ascertain when the number and denomination of the coins are equal to the correct fare.

Although various systems have been suggested to perform these tasks, such prior systems have not been entirely satisfactory. For example, many of the coin sensing systems utilized heretofore operated relatively slowly, and their capability to detect well made counterfeits was limited. In addition, the sensing systems previously employed often could only validate a limited number of different types of coins. Furthermore, and this has been of special moment for collection stations which are subject to heavy volume, a failure of a portion of the system rendered the entire station non-functional, and there was little or no way of periodically spot-checking the system to confirm the collection of the correct fare.

SUMMARY

One general object of this invention, therefore, is to provide new and improved apparatus for sensing groups of valid coins corresponding to a correct fare.

More specifically, it is an object of the invention to provide such coin sensing apparatus which can rapidly and accurately distinguish between many different types of coins and their counterfeit imitations.

Another object of the invention is to provide coin sensing apparatus of the character indicated which continues to operate in a degraded mode in the event of a break-down in a portion of the apparatus.

A further object of the invention is to provide coin sensing apparatus in which the coins collected from each fare may be readily cross-checked in a rapid and straight forward manner.

Still another object of the invention is to provide coin sensing apparatus which is economical to manufacture and thoroughly reliable in operation.

In one illustrative embodiment of the invention, the apparatus includes a transport system for continuously directing a plurality of successive coins along a feed path. A first coin sensor is disposed along the feed path for producing a denomination output signal corresponding to the diameter of a coin as it moves along the path, and a second coin sensor is arranged along the path to produce a phase and amplitude displacement output signal corresponding to the metal content of the moving coin. The output signals from the two sensors are received by an acquisition system and are directed to an analysis system which compares the denomination and phase and amplitude displacement signals with stored signals representative of valid coins. When the sum of valid coins as represented by the two signals equals the correct fare, the analysis system produces a validation signal which initiates the transfer of the deposited coins to suitable coin collection means.

In accordance with one feature of the invention, in certain particularly important embodiments, the acquisition system converts the denomination and phase and amplitude displacement output signals into corresponding standardized signals prior to transmitting the signals to the analysis system. With this arrangement, a wide variety of stored signals representative of valid coins may be utilized by the analysis system, and the overall flexibility and capacity of the apparatus is enhanced.

In accordance with another feature of several good embodiments of the invention, the coin collection means is in the form of two coin collectors disposed in succession along the coin feed path. The first coin collector discharges each group of received coins into the second coin collector in response to a validation signal from the analysis system, and the ensuing validation signal initiates the discharge of the group of coins in the second collector into a storage vault. The arrangement is such that the two successive fares in the first and second collectors may be crossed-checked visually before being sent to storage.

In accordance with a further feature of the invention, in some embodiments, only a single sensor is employed to provide the phase and amplitude displacement output signal corresponding to the metal content of the coin. The coin remains in motion during the entire sensing procedure, with the result that the coin detection operation is accomplished in a rapid and straight forward manner. The present invention, as well as further objects and features thereof, will be more fully understood from the ensuing description of certain preferred embodiments, when read with reference to the accompanying drawings.

BRIEF DESCRIPTION OF THE DRAWINGS

FIG. 3 is a schematic diagram of the acquisition circuit.

DESCRIPTION OF CERTAIN PREFERRED EMBODIMENTS

Figure 1:
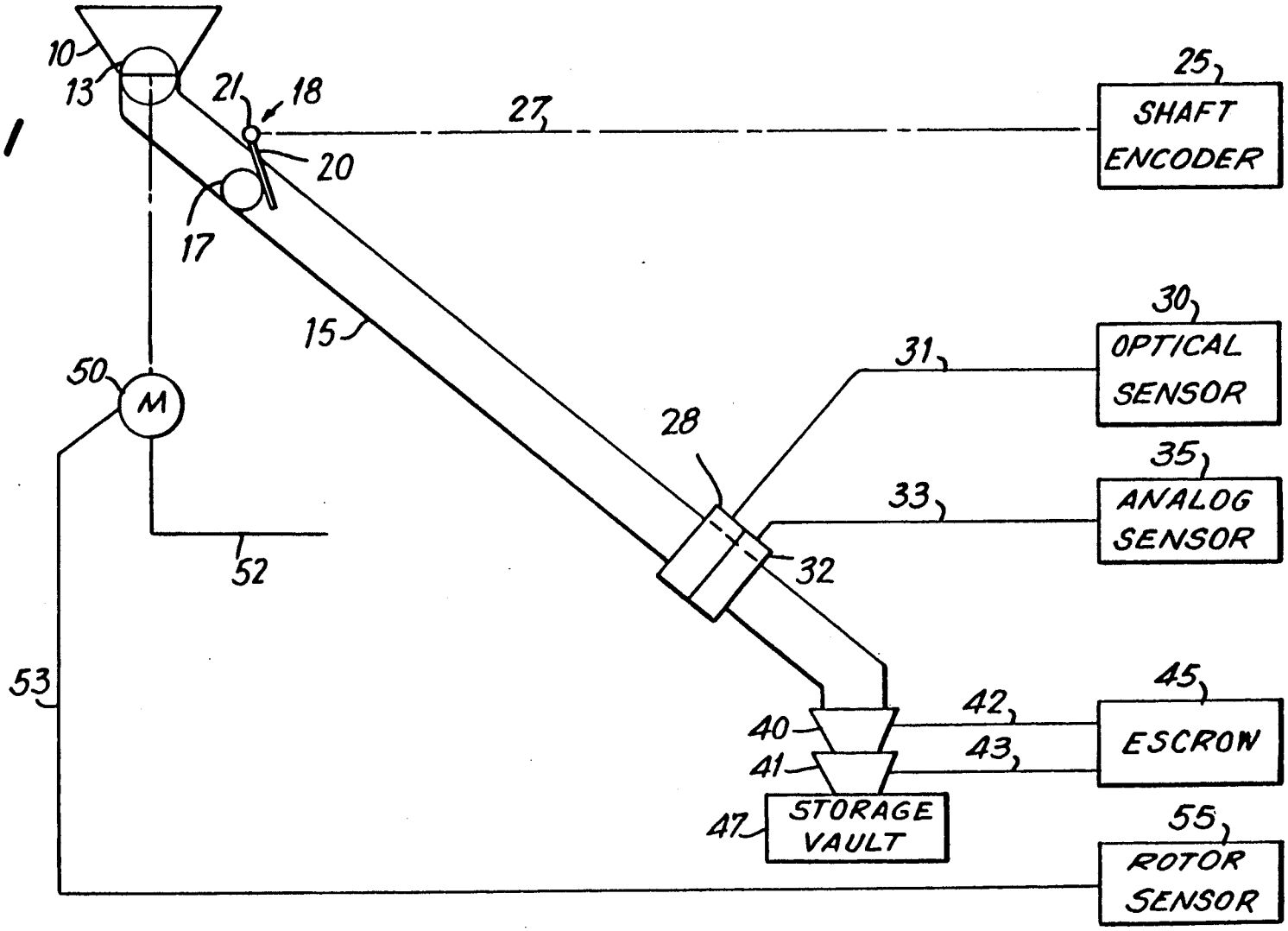
FIG. 1 is a schematic diagram of the coin receiving portion of sensing apparatus in accordance with one illustrative embodiment of the invention.

Referring to FIG. 1 of the drawings, there is shown coin sensing apparatus in accordance with an illustrative embodiment of the invention. The apparatus includes a coin hopper 10 in position to receive successive groups of coins corresponding to the correct fare from a motorist, for example. A motor driven wheel 13 is disposed adjacent the lower portion of the hopper 10. The wheel 13 serves to separate each group of deposited coins and to deliver the coins in each group one by one to a transporter in the form of an inclined coin track 15. The track 15 defines a feed path for the coins, and each successive coin remains continuously in motion as it moves along the track. The track advantageously is fabricated from a nonmagnetic material such as polycarbonate or plexiglass, for example.

As a coin such as the coin 17 proceeds along the feed path, it approaches a physical sizing station indicated generally at 18. The sizing station 18 includes a drag arm 20 which is deflected by the periphery of the coin to pivot a shaft 21 in a counterclockwise direction as viewed in FIG. 1, to an extent proportional to the coin's diameter. The shaft 21 is connected to a shaft encoder circuit 25 by an amplifying gear train shown schematically by the broken line 27. The circuit 25 produces a denomination output signal corresponding to the diameter of the coin as it moves along the coin track 15.

As each successive coin continues its movement along the coin track 15, it passes an optical detector 28. A photoelectric cell within the detector 28 produces an output signal which is directed to an optical sensor circuit 30 by a cable 31. The circuit 30 activates a transformer 32 which is disposed along the coin track 15 immediately adjacent the detector 28, and the voltages from the primary and secondary windings of the transformer 32 are transmitted over a cable 33 to an analog sensor 35. The primary winding is positioned on one side of the coin path, while the secondary winding is on the opposite side. In a manner that will become more fully apparent hereinafter, the detected voltages from these windings produce a phase and amplitude displacement output signal corresponding to the metal content of the moving coin.

From the transformer 32 the coins in each group proceed along the track 15 and are discharged into two collection hoppers 40 and 41. The hoppers 40 and 41 are disposed in succession along the coin feed path and are connected by respective leads 42 and 43 to an escrow circuit 45. The coins in a given group remain in the uppermost hopper 40 until a validation signal is received from the circuit 45 over the lead 42, at which time the group of coins is deposited in the lowermost hopper 41. Upon the receipt of a succeeding validation signal from the next group of coins, the circuit 45 activates the discharge of the group in the hopper 41 into a storage vault 47. The hoppers 40 and 41 are arranged such that their contents may be readily viewed by personnel monitoring the system.

The separator wheel 13 operates under the control of a motor shown schematically at 50. The motor 50 is provided with a power supply cable 52 and a second cable 53 leading to a rotor sensor circuit 55. The circuit 55 produces output signals corresponding to the speed of the motor and the angular position of the motor's output shaft.

Figure 2:
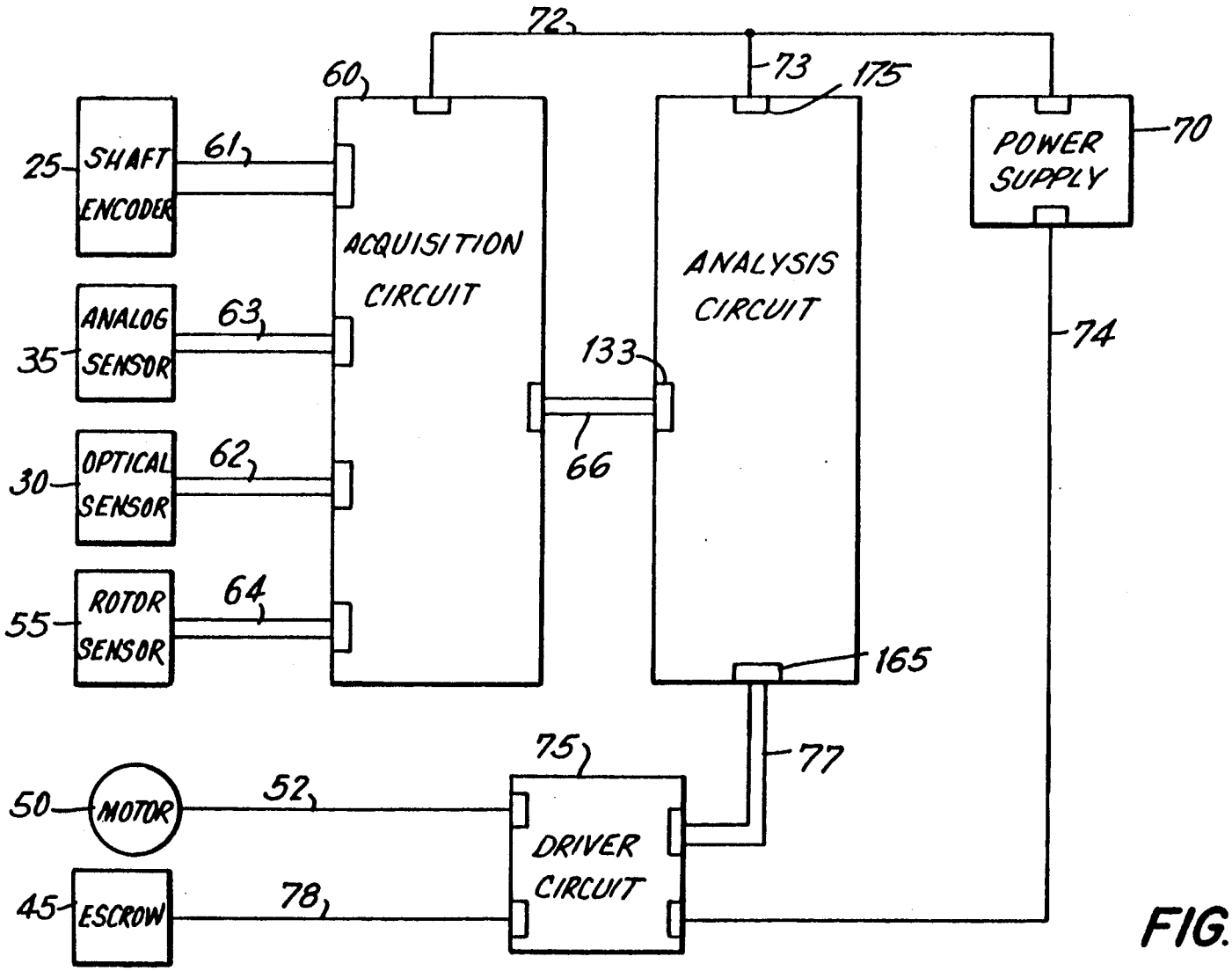
FIG. 2 is a schematic diagram showing the electrical connections between the acquisition circuit, the analysis circuit, the driver circuit and the other electrical components of the apparatus.

As best seen in FIG. 2, the shaft encoder 25, the optical sensor 30, the analog sensor 35 and the rotor sensor 55 are connected to an acquisition circuit 60 by respective cables 61, 62, 63 and 64. In a manner that will become more fully apparent hereinafter, the acquisition circuit 60 receives the various output signals from these cables and converts the signals into corresponding standardized signals. The resulting standardized signals are transmitted to an analysis circuit 65 over a cable 66. The circuits 60 and 65 are supplied with power from a power supply 70 over leads 72 and 73, respectively, and a lead 74 from the power supply similarly furnishes power to a driver circuit 75. The driver circuit 75 operates under the control of the analysis circuit 65 and is connected thereto by a cable 77. Output signals from the driver circuit are transmitted to the motor 50 over the lead 52 and to the escrow circuit 45 over a lead 78.

The acquisition circuit 60 comprises a microprocessor based interrogator of the system's sensors. The data collected from the various sensors is manipulated and normalized into a standard format to provide efficient real time transfer of coin parameters to the analysis circuit 65.

Referring to FIG. 3 of the drawings, shaft home position and relative offset signals generated by the shaft encoder 25 are transmitted over the lead 61 to a relative-to-absolute decoder 80. The decoder 80 converts the incoming signals to a signal corresponding to the diameter of the coin under test, and this signal is supplied over a lead 82 to a quadrature decoder 83. The decoder 83 drives a twelve bit magnitude register to digitize the coin diameter signal and supply the digitized signal to a microprocessor bus system 84 leading to a microprocessor controller 85. The bus system includes an eight bit high speed CMOS address mapped microprocessor with up to 16K words of both RAM and ROM, as indicated by the read-only-memory circuit 86 and the random-access-memory circuit 87.

The phase and amplitude displacement signal from the analog sensor 35 is generated by the primary winding 88 and the secondary winding 89 of the transformer 32. The primary winding 88 is connected across leads 92 and 93. These leads in turn are connected to a precision sine wave generator 95 which is supplied with power from a lead 97 connected to a reference power regulator 98. The generator 95 and the regulator 98 serve as a precision constant current source for the primary winding.

The signal at the primary winding 88 is detected by a buffer amplifier 100 and is then supplied over a lead 102 to a relative phase angle and amplitude detector 103. Similarly, the signal at the secondary winding 89 is supplied over leads 105 and 106 and branch leads 107 and 108 to an amplifier 110 and then over a lead 111 to the phase angle and amplitude detector 103. The detector 103 compares the phase and amplitude deviation between the reference coil driver signal on the primary winding and the resultant coil output signal on the secondary winding and produces a digitized output signal which is supplied to the bus system 84.

The amplitude of the signal across the secondary winding 89 is transmitted over the leads 105 and 106 to a precision gain amplifier 112, then over a lead 113 to an AC to DC root mean square converter 115 and then over a lead 116 to an eight bit analog-to-digital converter 118. The amplifier 112 amplifies and buffers the signal, and the converter 115 produces the resulting DC equivalent which is digitized by the converter 118. Power is supplied to the converter 118 by a lead 120 connected to the power regulator 98, and to compensate for any temperature or power supply induced drift, the converter is connected in a ratiomatic configuration. The digital output signal from the converter 118 is supplied to the microprocessor bus system 84. The quiescent phase and amplitude relationship, primary to secondary, as detected by the phase angle and amplitude detector 103, and the secondary voltage signal from the converter 118 will change as a function of the metal content of the coins being tested.

An analog comparator and detector 122 is utilized to interface the optical coin sensor 30 with a microprocessor bus interface 125 leading to the bus system 84. The sensor 30 is adjustable to provide for variations in sensor assembly tolerances.

As indicated heretofore, the rotor sensor 55 produces output signals corresponding to the speed of the motor 50 (FIG. 1) and the angular position of the motor's output shaft. These signals are transmitted over the cable 64 to an analog comparator 132 in the acquisition circuit 60. The comparator 132 serves as an interface between the rotor sensor 55 and the microprocessor bus system 84 leading to the memory circuits 86 and 87 and the microprocessor controller 85.

In addition to converting the output signals from the various sensors 25, 30, 35, 45 and 55 to standardized digital signals, the acquisition circuit 60 monitors the sensors for changes in operating parameters which may indicate a failure in a portion of the system. By comparing operating speed and the normal base line data from each sensor, problems are reported to the analysis circuit 65 over the cable 66. As an illustration, should erroneous readings be detected from the analog sensor 35 the acquisition circuit warns the analysis circuit that the analog data is invalid. The system then switches to a degraded state of operation in which coin collection continues but is monitored only by sizing data from the shaft encoder 25. The circuit 65 also generates a warning message to maintenance personnel so that the necessary repairs can be made.

Figure 4:
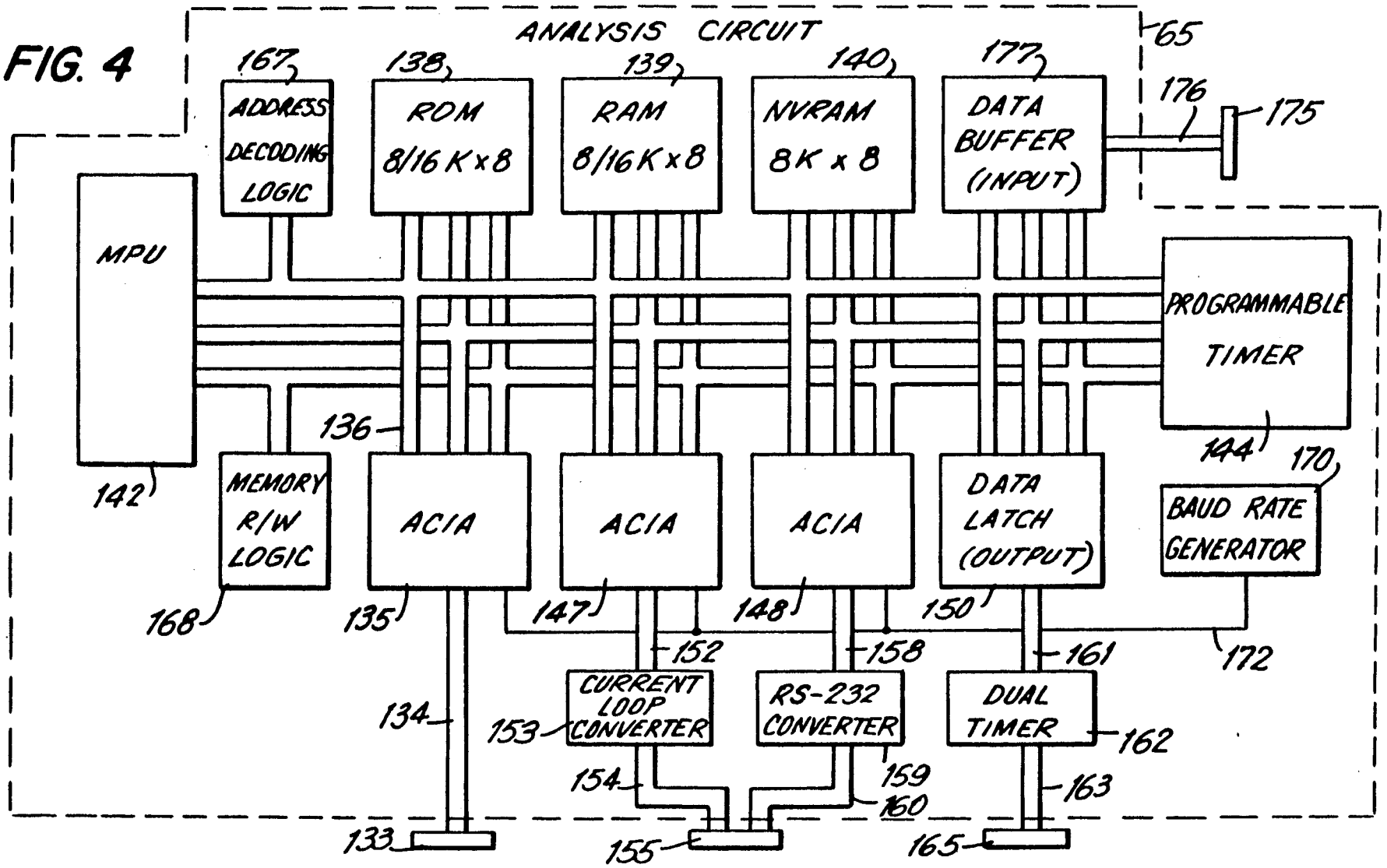
FIG. 4 is a schematic diagram of the analysis circuit.

The analysis circuit 65 is illustrated in more detail in FIG. 4. The circuit 65 comprises a microprocessor based evaluator of the coin data received from the acquisition circuit 60, and it includes various nonvolatile memories for storing coin parameters, fare rates and other data.

The incoming signals from the acquisition circuit 60 are received at a serial communications port 133 and are transmitted by a cable 134 to an asynchronous communications interface adaptor 135. The adaptor 135 in turn supplies the signals to a bus system 136 and then to a read-only-memory 138, a random access memory 139 and a nonvolatile random access memory 140. The bus system 136 is connected to a microprocessor unit 142 and to a triple programmable timer 144. The memory circuits 138, 139 and 140 are programmed to store valid data window values for all coins entered as acceptable payment as well as additional data representing fare rates, acceptable operating parameters, etc., while the timer 144 provides operational timing for the circuit.

The incoming data at the serial communications port 133 includes data representing the diameter and metal content of each successive coin as it moves along the coin track 15 (FIG. 1). The diameter and metal content data is compared with the stored valid data window values, and if the incoming data falls within the window of acceptable values for a particular coin (or token) the coin is assumed to be the coin listed in that entry. The values of the accepted coins for each payment are totalized, and upon receipt of a full fare the microprocessor unit 142 transmits an output signal over the bus system 136 to two asynchronous communications interface adapters 147 and 148 and a data latch circuit 150.

The adaptor 147 is connected by a cable 152 to a current loop converter 153, and a cable 154 serves to connect the converter 153 to a host and diagnostic port 155. Similarly, the adaptor 148 is connected by a cable 158 to a RS-232 converter 159 leading over a cable 160 to the port 155. The port 155 in turn is connected to a standard host system (not shown) to indicate that the correct fare has been paid and to transmit machine status and miscellaneous house keeping data. In addition, the port 155 may be employed as a diagnostic communications link to calibrate, test and monitor the various operating parameters and to input coin tables and fare rates.

The correct fare signals received by the data latch circuit 150 are transmitted over a cable 161 to a dual timer circuit 162. The circuit 162 includes two one-shot timers which alternately transmit the incoming signals over leads in a cable 163 to an output port 165. The port 165 is connected by the cable 7 (FIG. 2) to the driver circuit 75.

The microprocessor unit 142 is provided with an address decoding logic circuit 167 and a memory R/W logic circuit 168 which are connected to the unit by the bus system 136. Timing information is supplied to the interface adapters 135, 147 and 148 by a Baud rate generator 170 over a cable 172. Power is supplied to the analysis circuit from the power supply 70 (FIG. 2) and the lead 73 to a power input port 175. A cable 176 connects the port 175 to a data buffer circuit 177 leading to the bus system 136.

Figure 5:
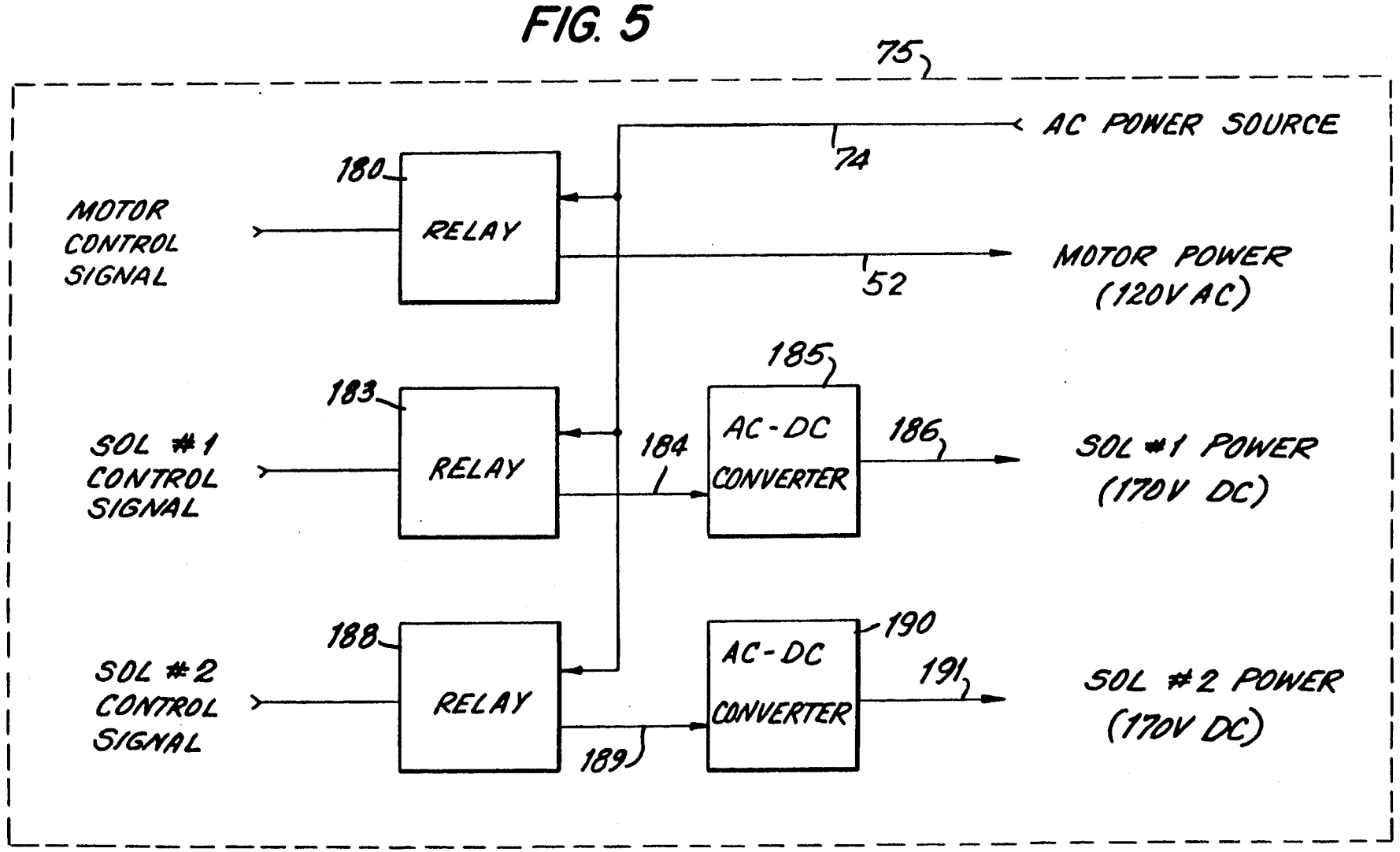
FIG. 5 is a schematic diagram of the driver circuit.

As indicated heretofore and as illustrated in FIG. 2, power also is supplied from the power supply 70 to the driver circuit 75. The driver circuit 75 serves to convert the control signals from the output port 165 of the analysis circuit 65 into levels capable of driving the electromechanical elements of the apparatus. In response to a validation signal from the analysis system, a solid state relay 180 (FIG. 5) is energized to supply AC power over the lead 52 to the motor 50 (FIG. 1). The motor 50 drives the separator wheel 13 preparatory to the discharge of the next group of coins into the hopper 10 and then in succession into the coin track 15. After an appropriate time delay as determined by the dual timer 162 (FIG. 4), power to the motor is interrupted to arrest the wheel 13 and thus prevent the transfer of a succeeding group of coins into the coin track.

The validation signal from the analysis circuit also energizes a solid state relay 183 in the driver circuit 75 to supply AC power over a lead 184 to an AC-DC converter 185. The DC output from the converter 185 is transmitted over a lead 186 to a solenoid within the escrow circuit 45. Upon energization of this solenoid, the coins within the upper hopper 40 are discharged into the lower hopper 41 where they continue to be available for inspection by personnel monitoring the system.

The validation signal from the analysis circuit also is received by a solid state relay 188 to thereby energize the solid state relay and transmit AC power over a lead 189 to an AC-DC converter 190. The DC output from the converter 190 is applied over a lead 191 to energize a second solenoid in the escrow circuit 45 and thereby discharge the preceding group of coins from the hopper 41 into the vault 47. The hoppers 40 and 41 are readily accessible to monitoring personnel, and in the event of the absence of a proper validation signal or other discrepancy their contents may be cross-checked visually prior to the time the coins enter the vault.

Figure 6:
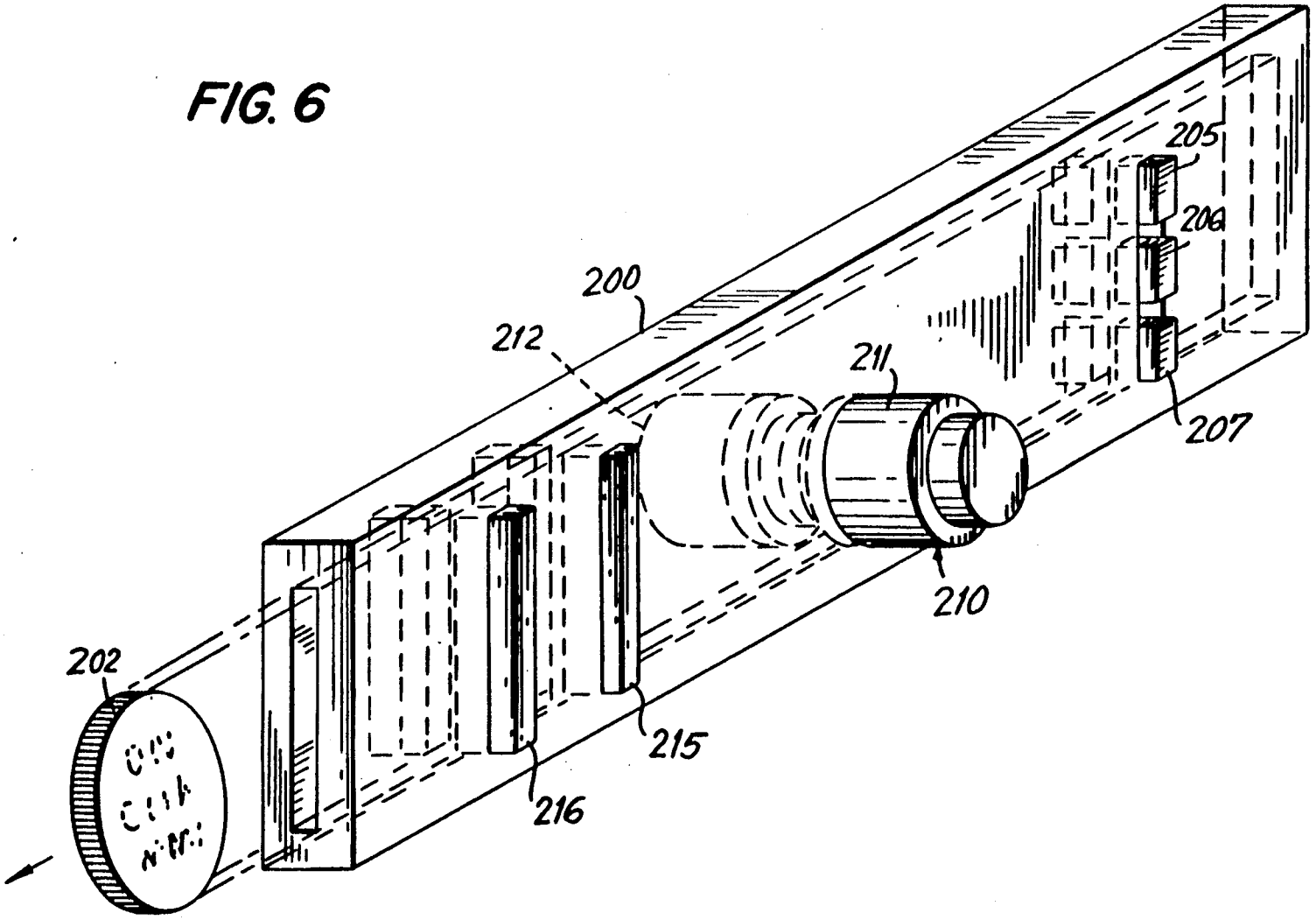
FIG. 6 is a perspective view of the coin receiving portion of sensing apparatus in accordance with another illustrative embodiment of the invention.

Referring now to FIG. 6, there is shown coin sensing apparatus in accordance with another illustrative embodiment of the invention. The apparatus includes a coin track 200 which defines a feed path for groups of coins, such as the coin 202, as they move in succession from right to left along the track. As in the previously described embodiment, each successive coin remains continuously in motion during its movement, and the track 200 is constructed from a nonmagnetic transparent material such as polycarbonate or plexiglass. The coins are received from a hopper such as the hopper 10 shown in FIG. 1, and upon leaving the coin track they enter the successive hoppers 40 and 41 and are then discharged into the storage vault 47.

Shortly after each coin enters the coin track 200, it passes an optical sensing station which includes three optical sensors 205, 206 and 207. These sensors perform a function similar to that of the optical detector 28 in the FIG. 1 embodiment and are connected to the optical sensor circuit 30 to alert the system that the coin is entering the coin analysis section of the feed path. The coin then proceeds past a transformer 210 having a primary winding 211 and a secondary winding 212 disposed on opposite sides of the path. The quiescent phase and amplitude relationship between these windings, and the voltage on the secondary winding, change as a function of the metal content of the coin as it interrupts the magnetic field between the windings. The phase and amplitude relationship and voltage are used to determine the coin's metal content in the manner described heretofore.

As the coin proceeds along the track 200, the leading edge of the coin interrupts an optical sensor 215 to start two independent clocks. The first clock runs as long as the coin is interrupting the sensor 215 to produce a count proportional to the period of time needed for the coin to pass the sensor. The second clock runs until the leading edge of the coin interrupts an optical sensor 216, at which time the count of the second clock is terminated to produce a count proportional to the period of time required for the coin to move from the sensor 215 to the sensor 216. Through the use of standard circuitry, the clock counts from the first clock are divided by the clock counts from the second clock to provide a signal equal to the diameter of the coin. This signal is supplied over the cable 61 (FIG. 2) to the acquisition circuit 60 and is processed by the acquisition circuit and the analysis circuit 65 to facilitate a determination as to the validity of the coin.

The terms and expressions which have been employed are used as terms of description and not of limitation, and there is no intention in the use of such terms and expressions of excluding any equivalents of the features shown and described, or portions thereof, it being recognized that various modifications are possible within the scope of the invention claimed.

What is claimed is:

1. Coin sensing apparatus comprising, in combination:

means for continuously directing a plurality of successive coins along a feed path;

a first coin sensor disposed along the feed path, said first coin sensor comprising arm means for engaging the periphery of each successive coin as it moves along the feed path, shaft means for rotatably mounting said arm, shaft encoder means operatively connected to said shaft for producing an output representative of angular rotation of said shaft, and processing means for processing said output from said shaft encoder means to produce a digital denomination output signal representative of the diameter of said coin as it moves along said path;

an additional coin sensor disposed along the feed path, the additional coins sensor producing a phase and amplitude displacement output signal corresponding to the metal content of said moving coin;

an acquisition system for receiving the output signals from said coin sensors and converting the same into corresponding standardized signals;

an analysis system connected to the acquisition system for comparing the standardized signals corresponding to said denomination and phase and amplitude displacement signals with stored signals representative of valid coins, the analysis system producing a validation signal when the sum of valid coins as represented by the denomination and phase and amplitude displacement signals equals a predetermined correct fare; and coin collection means disposed along said feed path for receiving groups of coins, in response to a validation signal from said analysis system.

2. Coin sensing apparatus as defined by claim 1, in which the first coin sensor comprises a pair of optical sensing devices in spaced relationship with each other along said feed path.

3. Coin sensing apparatus comprising, in combination:

means for directing a plurality of successive coins along a feed path;

a first coin sensor disposed along the feed path for producing a denomination output signal corresponding to the diameter of a coin as it moves along said path;

an additional coin sensor disposed along the feed path, the additional coin sensor producing a phase and amplitude displacement output signal corresponding to the metal content of said moving coin;

an acquisition system for receiving the output signals from said coin sensors and converting the same into corresponding standardized signals;

an analysis system connected to the acquisition system for comparing the standardized signals corresponding to said denomination and phase and amplitude displacement signals with stored signals representative of valid coins, the analysis system producing a validation signal when the sum of valid coins as represented by the denomination and phase and amplitude displacement signals equals the correct fare; and first and second coin collection means disposed in succession along said feed path for receiving groups of coins corresponding to the correct fare, the first coin collection means having means for discharging each group of received coins into the second coin collection means in response to a validation signal from said analysis system.

4. Coin sensing apparatus comprising, in combination:

means for continuously directing a plurality of successive coins along a feed path;

a first coin sensor disposed along the feed path, said first coin sensor comprising arm means for engaging the periphery of each successive coin as it moves along the feed path, shaft means for rotatably mounting said arm, shaft encoder means operatively connected to said shaft for producing an output representative of angular rotation of said shaft, and processing means for processing said output from said shaft encoder means to produce a digital denomination output signal representative of the diameter of said coin as it moves along said path;

an additional coin sensor disposed along the feed path, the additional coin sensor including a single transformer having primary and secondary windings disposed on opposite sides of said feed path for producing phase and amplitude and secondary voltage output signals in response to said moving coin;

an acquisition system for receiving the output signals from said coin sensors and converting the same into corresponding standardized signals, acquisition system including circuit means for generating a standardized signal proportional to the metal content of said coin from said phrase and secondary voltage output signals;

an analysis system connected to the acquisition system for comparing the standardized signals corresponding to said denomination and metal content signals with stored signals representative of valid coins, the analysis system producing a validation signal when ten sum of valid coins as represented by the denomination and metal content signals equals a predetermined correct fare; and coin collection means disposed along said fed path for receiving groups of coins in response to a validation signals from said analysis system.

5. Coin sensing apparatus comprising, in combination:

means for directing a plurality of successive coins along a feed path;

a first coin sensor disposed along the feed path for producing a denomination output signal corresponding to the diameter of a coin as it moves along said path;

an additional coin sensor disposed along the feed path, the additional coin sensor including a single transformer having primary and secondary windings disposed on opposite sides of said feed path for producing phase and amplitude output signals in response to said moving coin;

an acquisition system for receiving the output signals from said coin sensors and converting the same into corresponding standardized signals, the acquisition system including circuit means for generating a first standardized signal proportional to the diameter of said coin from said denomination output signal and a second standardized signal proportional to the coin's metal content from said phase and amplitude output signals;

an analysis system connected to the acquisition system for comparing the first and second standardized signals with stored signals representative of valid coins, the analysis system producing a validation signal when the sum of valid coins as represented by the first and second standardized signals equals the correct fare; and first and second coin collection means disposed in succession along said feed path for receiving groups of coins corresponding to the correct fare, the first coin collection means having means for discharging each group of received coins into the second coin collection means in response to a validation signals form said analysis system.

6. Coin sensing apparatus as defined by claim 5, which further comprises, in combination:

a driver circuit connected to said analysis system for receiving validation signals therefrom and amplifying the same; and means for supplying the amplified validation signals to said first and second coin collection means.

7. Coin sensing apparatus as defined by claim 5, which further comprises, in combination;

rotary means operatively associated with the coin directing means for separately directing each successive coin along said feed path;

means for initiating operation of the rotary means in response to a validation signal from said analysis system; and means for arresting operation of the rotary means a predetermined time interval after the receipt of a validation signal.

8. Coin sensing apparatus comprising, in combination:

rotary means for directing a plurality of successive coins along a feed path;

a first coin sensor disposed along the feed path, said first coin sensor comprising arm means for engaging the periphery of each successive coin as it moves along the feed path, shaft means for rotatably mounting said arm, shaft encoder means operatively connected to said shaft for producing an output representative of angular rotation of said shaft, and processing means for processing said output from said shaft encoder means to produce a digital denomination output signal representative of the diameter of said coin as it moves along said path;

an additional coin sensor disposed along the feed path, the additional coin sensor including a single transformer having primary and secondary windings disposed on opposite sides of said feed path for producing phase and amplitude displacement and secondary voltage output signals in response to said moving coin;

an acquisition system for receiving the output signals from said coin sensors and converting the same into corresponding standardized signals, the acquisition system including circuit means for generating a standardized signal proportional to the metal content of said coin from said phase and amplitude and secondary voltage output signals;

an analysis system connected to the acquisition system for comparing the standardized signals corresponding to said denomination and metal content signals with stored signals representative of valid coins, the analysis system producing a validation signal when the sum of valid coins as represented by the denomination and metal content signals equals a predetermined correct fare;

coin collection means disposed along said feed path for receiving groups of coins corresponding to the predetermined correct fare in response to a validation signals from said analysis system;

a driver circuit connected to said analysis system for receiving validation signals therefrom and amplifying the same; and means for supplying the amplified validation signals to said rotary means and said coin collection means.

9. Coin sensing apparatus as defined by claim 8, in which the first coin sensor comprises a pair of optical sensing devices in spaced relationship with each other along said feed path, timing means including two clock circuits connected to said optical sensing devices, the operation of each of said clock circuits being initiated as the leading edge of a coin passes a first of said optical sensing devices, the operation of one of said clock circuits being terminated as the trailing edge of said coin passes said first optical sensing device and the operation of the other clock circuit being terminated as the leading edge of said coin passes the second optical sensing device, and means responsive to the operation of said clock circuits for producing said denomination output signal corresponding to the diameter of said coin.

10. Coin sensing apparatus comprising, in combination:

rotary means for directing a plurality of successive coins along a feed path;

a first coin sensor disposed along the feed path, said first coin sensor comprising arm means for engaging the periphery of each successive coin as it moves along the feed path, shaft means for rotatably mounting said arm, shaft encoder means operatively connected to said shaft for producing an output representative of angular rotation of said shaft, and processing means for processing said output from said shaft encoder means to produce a digital denomination output signal representative of the diameter of said coin as it moves along said path;

an additional coin sensor disposed along the feed path, the additional coin sensor including a single transformer having primary and secondary windings disposed on opposite sides of said feed path for producing phase and amplitude displacement and secondary voltage output signals in response to said moving coin;

an acquisition system for receiving the output signals from said coin sensors and converting the same to corresponding standardized signals, the acquisition system including circuit means for generating a first standardized signal proportional to the diameter of said coin from said denomination output signal and a second standardized signal proportional to the coins metal contents from said phase and amplitude displacement and secondary voltage output signals;

an analysis system connected to the acquisition system for comparing the first and second standardized signals with stored signals representative of valid coins, the analysis system producing a validation signal when the sum of valid coins as represented by the first and second standardized signals equals a predetermined correct fare;

first and second coin collection means disposed in succession along said feed path for receiving groups of coins corresponding to the predetermined correct fare, the first coin collection means discharging each group of received coins into the second coin collection means in response to a validation signals from said analysis system;

a driver circuit connected to said analysis system for receiving validation signals therefrom and amplifying the same; and means for supplying the amplified validation signals to said rotary means and said coin collection means.

11. Coin sensing apparatus comprising, in combination:

means for continuously directing a plurality of successive coins along a feed path;

a first coin sensor disposed along the feed path adapted to produce a denomination output signal corresponding to the diameter of a coin as it moves along said path;

an additional coin sensor disposed along the feed path, the additional coin sensor being adapted to produce a phase and amplitude displacement output signal corresponding to the metal content of said moving coin;

an acquisition system for receiving the output signals from said coin sensors and converting the same into corresponding standardized signals;

an analysis system connected to the acquisition system for comparing the standardized signals corresponding to said denomination and phase and amplitude displacement signals with stored signals representative of valid coins, the analysis system producing a validation signal when the sum of valid coins as represented by the denomination and phase and amplitude displacement signals equals a predetermined correct fare;

means for detecting whether readings from said additional sensor are erroneous;

means for automatically switching to a degraded mode permitting operation using said first coin sensor alone when said erroneous readings are detected;

means for generating a warning to maintenance personnel when the system is in said degraded mode; and coin collection means disposed along said feed path for receiving groups of coins, in response to a validation signal from said analysis system.

12. Coin sensing apparatus comprising, in combination:

means for continuously directing a plurality of successive coins along a feed path;

a first coin sensor disposed along the feed path adapted to produce a denomination output signal corresponding to the diameter of a coin as it moves along said path;

an additional coin sensor disposed along the feed path, the additional coin sensor including a single transformer having primary and secondary windings disposed on opposite sides of said feed path adapted to produce phase and amplitude and secondary voltage output signals in response to said moving coin;

an acquisition system for receiving the output signals from said coin sensors and converting the same into corresponding standardized signals, acquisition system including circuit means for generating a standardized signal proportional to the metal content of said coin from said phase and secondary voltage output signals;

an analysis system connected to the acquisition system for comparing the standardized signals corresponding to said denomination and metal content signals with stored signals representative to valid coins, the analysis system producing a validation signal when the sum of valid coins as represented by the denomination and metal content signals equals a predetermined correct fare;

means for detecting whether readings from said additional sensor are erroneous;

means for automatically switching to a degraded mode permitting operation using said first coin sensor alone when said erroneous readings are detected;

means for generating a warning to maintenance personnel when the system is in said degraded mode; and coin collection means disposed along said feed path for receiving groups of coins in response to a validation signals from said analysis system.

13. Coin sensing apparatus comprising, in combination:

rotary means for directing a plurality of successive coins along a feed path;

a first coin sensor disposed along the feed path adapted to produce a denomination output signal corresponding to the diameter of a coin as it moves along said path;

an additional coin sensor disposed along the feed path, the additional coin sensor including a single transformer having primary and secondary windings disposed on opposite sides of said feed path adapted to produce phase and amplitude displacement and secondary voltage output signals in response to said moving coin;

an acquisition system for receiving the output signals from said coin sensors and converting the same into corresponding standardized signals, the acquisition system including circuit means for generating a standardized signal proportional to the metal content of said coin from said phase and amplitude and secondary voltage output signals;

an analysis system connected to the acquisition system for comparing the standardized signals corresponding to said denomination and metal content signals with stored signals representative of valid coins, the analysis system producing a validation signal when the sum of valid coins as represented by the denomination and metal content signals equals a predetermined correct fare;

means for detecting whether readings from said additional sensor are erroneous;

means for automatically switching to a degraded mode permitting operation using said first coin sensor alone when said erroneous readings are detected;

means for generating a warning to maintenance personnel when the system is in said degraded mode; and coin collection means disposed along said feed path for receiving groups of coins corresponding to the predetermined correct fare in response to a validation signals from said analysis system;

a driver circuit connected to said analysis system for receiving validation signals therefrom and amplifying the same; and means for supplying the amplified validation signals to said rotary means and said coin collection means.

14. Coin sensing apparatus comprising, in combination:

rotary means for directing a plurality of successive coins along a feed path;

a first coin sensor disposed along the feed path adapted to produce a denomination output signal corresponding to the diameter of a coin as it moves along said path;

an additional coin sensor disposed along the feed path, the additional coin sensor including a single transformer having primary and secondary windings disposed on opposite sides of said feed path adapted to produce phase and amplitude displacement and secondary voltage output signals in response to said moving coin;

an acquisition system for receiving the output signals from said coin sensors and converting the same into corresponding standardized signals, the acquisition system including circuit means for generating a first standardized signal proportional to the diameter of said coin from said denomination output signal and a secondary standardized signal proportional to the coin's metal content from said phase and amplitude displacement and secondary voltage output signals;

an analysis system connected to the acquisition system for comparing the first and second standardized signals with stored signals representative of valid coins, the analysis system producing a validation signal when the sum of valid coins as represented by the first and second standardized signals equals a predetermined correct fare;

means for detecting whether readings from said additional sensor are erroneous;

means for automatically switching to a degraded mode permitting operation using said first coin sensor alone when said erroneous readings are detected;

means for generating a warning to maintenance personnel when the system is in said degraded mode; and first and second coin collection means disposed in succession along said feed path for receiving groups of coins corresponding to the predetermined correct fare, the first coin collection means discharging each group of received coins into the second coin collection means in response to a validation signals from said analysis system;

a driver circuit connected to said analysis system for receiving validation signals therefrom and amplifying the same; and means for supplying the amplified validation signals to said rotary means and said coin collection means.

* * * * *

UNITED STATES PATENT AND TRADEMARK OFFICE

CERTIFICATE OF CORRECTION

PATENT NO. : 5,097,934

DATED : March 24, 1992

INVENTOR(S) : Thomas J. Quilan, Jr.

It is certified that error appears in the above-identified patent and that said Letters Patent is hereby corrected as shown below:

CLAIM 4

Col. 9, line 16, change "ten" to --the--;

Col. 9, line 19, change "fed" to --feed--.

Signed and Sealed this

Eighth Day of June, 1993

Michael K. Kirk

Attest:

MICHAEL K. KIRK

Attesting Officer

Acting Commissioner of Patents and Trademarks